United States Patent [19]

Bradshaw

[11] 4,261,608

[45] Apr. 14, 1981

[54] SELF-FEEDING TONGS

[76] Inventor: Marilyn J. Bradshaw, 1314 S. King St., Honolulu, Hi. 96814

[21] Appl. No.: 14,585

[22] Filed: Feb. 23, 1979

[51] Int. Cl.[3] ..... A47G 21/10; A47J 43/28

[52] U.S. Cl. ..... 294/25; 294/99 R

[58] Field of Search ..... 294/3, 8.5, 11, 16, 294/25, 33, 99 R, 99 S; D7/105; 30/147–150; 81/43; 128/321, 354

[56] References Cited

U.S. PATENT DOCUMENTS

| | | | |
|---|---|---|---|
| D. 165,869 | 2/1952 | Reiner | D7/105 |
| D. 195,865 | 8/1963 | Sundquist | D7/105 |
| 993,720 | 5/1911 | Schneider | 294/25 X |
| 2,601,766 | 7/1952 | Riddell et al. | 294/99 R X |
| 2,711,339 | 6/1955 | McGogy | 294/11 X |
| 2,864,645 | 12/1958 | Meldrum | 294/106 |

*Primary Examiner*—Johnny D. Cherry

*Attorney, Agent, or Firm*—George W. T. Loo

[57] ABSTRACT

Self-feeding tongs for use by most handicapped persons. The tongs include a pair of arms integrally joined to a hinge. Each arm has a rounded tip end, a gripping surface, a flat surface, and a loop. The loop is located on the outside of the arm adjacent the hinge and is adapted to accommodate the thumb or at least two fingers of a user. Each loop is perpendicular to the longitudinal axis of the arm to which it is attached. The hinge has a positive pressure which spread the tip ends apart, allows a handicapped person by pressure of the thumb and fingers to bring the tip ends together so that a piece of food can be grasped, and forces the tip ends open so that the grasped food may be released and eaten. The tongs are held in the palm of a hand in a relaxed pen grasp. The thumb and fingers are squeezed together to move the tip ends towards one another to grip and pick up pieces of food.

6 Claims, 6 Drawing Figures

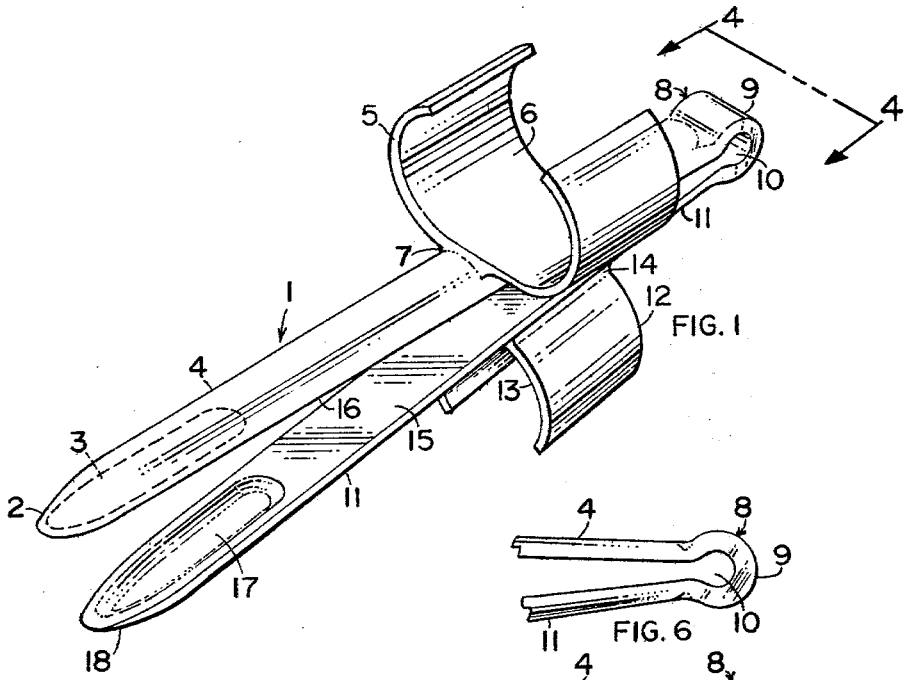
FIG. 1
FIG. 6
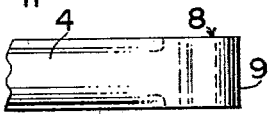
FIG. 5
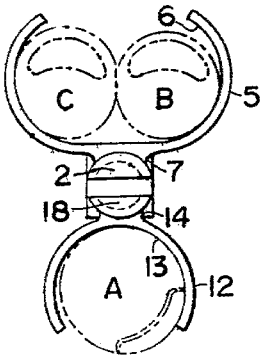
FIG. 3
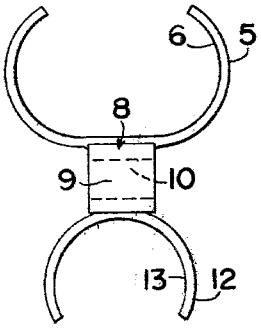
FIG. 4
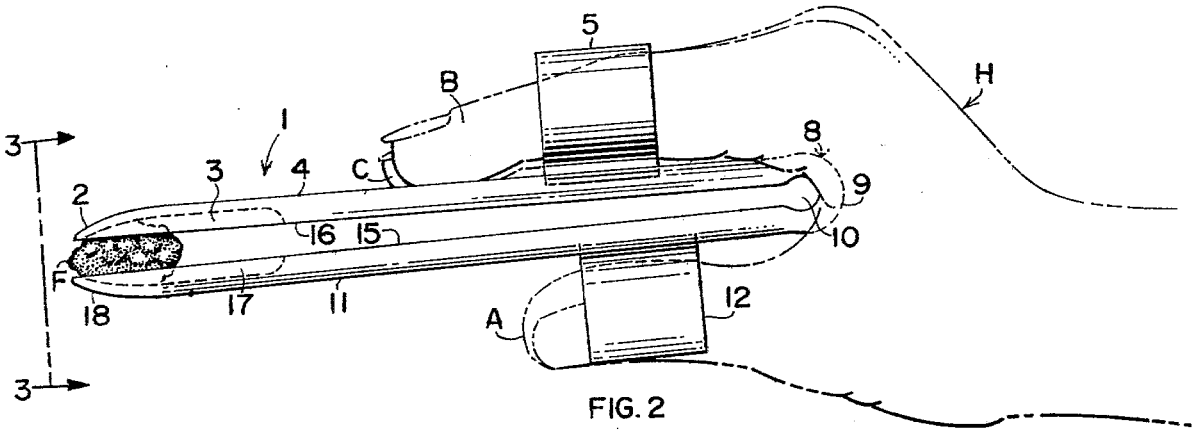
FIG. 2

SELF-FEEDING TONGS

BACKGROUND OF THE INVENTION

1. Field of Invention

This invention pertains to tongs and chopsticks.

2. Description of the Prior Art

Hedquist, U.S. Pat. No. 2,300,894, dated Nov. 3, 1942, discloses tongs. Law, U.S. Pat. No. 3,640,561, dated Feb. 8, 1972, discloses a chopstick device. Prior art tongs or chopsticks can not be readily used by a handicapped person to feed himself.

3. Prior Art Statement

Hedquist's tongs were designed for grasping and removing clothes from hot water in laundering operation. The tongs are too cumbersome to be used in the self-feeding of a handicapped person.

Law's chopstick device simulates the conventional chopsticks. The chopstick device would be difficult for a handicapped person to use to feed himself for the following reasons: (1) Difficult for a handicapped person to hold it. (2) Optimal holding position for handicapped persons is two or more fingers in opposition to the thumb, not just the first finger. (3) Slippage of members 1 and 2 is likely when the user's fingers have little or no strength. (4) Not operable by hand muscles alone. (5) Insufficient grasping surface.

My invention is a utensil adapted to handicapped capabilities. It is designed to allow a handicapped person to self feed and bite select. It is designed to secure to the handicapped persons a physical and psychological independence necessary for their morale.

SUMMARY OF THE INVENTION

This invention relates to self-feeding tongs for handicapped persons. It has a positive pressure hinge to keep the free end of the arms apart and two loops to accommodate the thumb and fingers of a user. It operates as a Class III lever. It is designed especially for handicapped persons who have difficulty in letting go of an object after they have grasped it. The positive pressure hinge will force the arms apart for them.

An object of this invention is to provide self-feeding tongs for handicapped persons.

Another object of this invention is to provide economical self-feeding tongs that are easy to make and use.

A further object of this invention is to provide self-feeding tongs which are safe enough to be used for eating and which can be cleaned hygienically without difficulty.

Still another object of this invention is to provide self-feeding tongs that may be used by the blind, the arthritic, the parkinsonian, the plegic, the dysplastic, and other handicapped persons.

A still further object of this invention is to provide self-feeding tongs that will free nursing and auxiliary help from the necessity of feeding handicapped persons.

Another object of this invention is to provide self-feeding tongs that will provide an element of physical and psychological independence for the handicapped persons.

Other objects, features and advantages of the present invention will be readily apparent from the following detailed description taken in connection with the accompanying drawing.

BRIEF DESCRIPTION OF THE DRAWING

FIG. 1 is a perspective view of the invention at rest with the arms held open by the positive pressure hinge.

FIG. 2 is a side view of the invention in use with two fingers and a thumb in position holding a piece of food.

FIG. 3 is an enlarged front view of the invention taken on line 3—3 of FIG. 2.

FIG. 4 is an enlarged rear view of the invention taken on line 4—4 of FIG. 1.

FIG. 5 is a fragmentary plan view of the hinge and an arm.

FIG. 6 is a fragmentary side view of the hinge and arms.

DESCRIPTION OF THE PREFERRED EMBODIMENT

Before explaining the present invention in detail it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing wherein like reference letters and numerals refer to like and corresponding parts throughout the several views, the preferred embodiment of the invention disclosed in FIGS. 1–6 inclusive is tongs 1. Tongs 1 includes two arms 4 and 11 joined together at one of their ends to hinge 8. Arm 4 includes tip end 2, concave distal 3, flat surface 16, and loop 5. Arm 11 includes tip end 18, concave distal 17, flat surface 15, and loop 12. Hinge 8 includes bend 9 and inner surface 10.

Loop 5 has a curved surface 6. It is attached to arm 4 at right angle to the longitudinal axis of arm 4 with a smooth connection at 7. Loop 5 is designed to hold two fingers B and C for better control. It may hold one or three fingers. It may be expanded to hold three fingers by expanding the sides of the loop.

Loop 12 has a curved surface 13. It is attached to arm 11 at right angle to the longitudinal axis of arm 11 with a smooth connection at 14. Loop 12 is designed to hold thumb A.

Loops 5 and 12 are attached to arms 4 and 11, respectively, so that the distal joints of fingers B and C and thumb A of a user will fit within them. I have found a satisfactory position for the front edge of loop 5 to be at the junction of the proximal first third and second third of the length of arm 4 and hinge 8 and a satisfactory position for the front edge of loop 12 to be offset approximately 3/16" behind the front edge of loop 5.

Loops 5 and 12 are made 1" in width for stability. If it is deemed desirable, it may be made narrower or larger with the resultant lesser or great stability. The length of loop 5 may vary from 1½" to 2", depending on the size and number of fingers to be accomodated therein. The length of loop 12 is approximately 1". Loops 5 and 12 are made of a flexible materials so as to accomodate the various sizes of fingers and thumbs. Loops 5 and 12 may be made integrally with arms 4 and 11 or may be attached to respective arms 4 and 11 with smooth connections to eliminate potential contamination areas.

Tip ends 2 and 18 are rounded to protect the face and lips of the user. They are approximately ½" in width.

Concave distals 3 and 17 are shallow concavities with a length of approximately one-fourth of the length of tongs 1. The remaining portion of arms 4 and 11 are solid. Concave distals 3 and 17 provide a better holding surface for piece of food F. Their shape and size may be varied and they may be serrated, perforated, or smooth. Food particles F can be gripped gently, but firmly, and will not slip out. Concave distals 3 and 17 handle food particles F with ease.

Hinge 8 has a positive pressure in the range of 1.36 kg to 5.4 kg. At rest arms 4 and 11 form with hinge 8 an angle of approximately 45° and tip ends 2 and 18 are approximately 2½" apart. The angle may be made smaller if it is deemed desirable. For example, the angle may be 30° in which case tip ends 2 and 18 will be approximately 2" apart; or the angle may be 15° in which case tip ends 2 and 18 will be approximately 1" apart. I prefer an initial angle of approximately 45° as I want sufficient positive pressure at hinge 8 and as the angle will get smaller through use of tongs 1.

Arms 4 and 11 are parallel in function. When they are functioning, they are parallel; when they are at rest, they are divergent. See FIGS. 1 and 2. Flat surfaces 15 and 16 may be made to contact each other, but normally they do not contact each other. Depending on the amount of positive pressure of hinge 8 (1.36 kg to 5.4 kg), a slightly greater amount of pressure exerted by thumb A and fingers B and C on arms 4 and 11 will cause tip ends 2 and 18 to close, allowing concave distals 3 and 17 to grasp food F.

For a handicapped person, one whose reflexes are not classified as normal, the optimal pressure is 2.7 kg. With tongs 1 held open by the positive pressure, the handicapped person can aim tip ends 2 and 18 or feel for food F, in case of a blind person. Then, by deliberately contracting his arm muscles, a slightly greater pressure is exerted by thumb A and fingers B and C on arms 4 and 11 to cause tip ends 2 and 18 to close and allow concave distals 3 and 17 to grasp food F. Contraction of the arm muscles again is required to approach the face of the user. A handicapped person frequently aims his mouth to the food. At this point the handicapped person frequently can not let go of tongs 1. Positive pressure is needed to force tip ends 2 and 18 open so that food F may be deposited in the user's mouth. After a brief rest, the arm muscles of the user are again ready to contract for another bite selection. The inability of handicapped persons who are aged or who have damaged nervous systems to let go of a grasped object is a long recognized syndrome. My invention is designed to aid handicapped persons in letting go of the grasped object. My invention operates as a Class III lever and utilizes a positive pressure hinge to force the arms apart so that the grasped object may be let go.

Loops 5 and 12 are positioned at right angle to the longitudinal axis of arms 4 and 11 to prevent or minimize torque. Arms 4 and 11 twist less or not at all when pressure is applied by thumb A and fingers B and C, when they are positioned in loops 5 and 12. Lateral stabilization is secured by loops 5 and 12.

While one finger and thumb pressure of a normal person is sufficient to cause tip ends 2 and 18 to close, a handicapped person will need the pressure from at least two fingers and thumb to cause tip ends 2 and 18 to close. Some handicapped persons will need pressure from three fingers and thumb to cause tip ends 2 and 18 to close.

In the preferred embodiment, my invention is made of plastic. It has an overall length of 6". The width of the arms and hinge is ½". The thickness of arms and hinge is 3/16". Loop 5 has a width of 1", a length of 1½" to 2", depending on the number of fingers to be accomodated, and a thickness of 1/16". Loop 12 has a width of 1", a length of 1", and a thickness of 1/16". The length of concave distals 3 and 17 is 1½". Space between tip ends 2 and 18 is 2½" when arms 4 and 11 are in the at rest position. Space between arms 4 and 11, when they are parallel to each other is ⅛". The front edge of loop 5 is located 2" from the rear. The front edge of loop 12 is offset 3/16" to the rear of the front edge of loop 5 and is located 1 13/16" from the rear.

Tongs 1 may be constructed of plastic, metal, or any other material that will be easy to clean and sterilize. It may be constructed of a combination of materials, so long as the materials are easy to clean and sterilize.

Positive pressure hinge 8 can be made by utilizing properties of certain metals or by utilizing various polymer monomer ratios of plastics. No spring or parts held by an axis is used in my invention as springs or axis hinges are not easily cleaned and sterilized. A simple hinge facilitiates hygienic washability.

My invention is used by a handicapped person in the following manner: (1) Tongs 1 is held with the hinge 8 in the palm of hand H, fingers B and C are accomodated within loop 5, and thumb A is accomodated within loop 12. See FIGS. 2 and 3. (2) Tip ends 2 and 18 are moved towards a piece of food F to be grasped so that food F is located between concave distals 3 and 17. A sighted person will aim the tip ends 2 and 18 at food F, while a blind person will feel for food F. (3) Arms 4 and 11 are brought together by pressure caused by squeezing fingers B and C and thumb A toward each other, by moving fingers B and C toward thumb A, or by moving thumb A toward fingers B and C. The user will do so by deliberately contracting his arm muscles. (4) Food F is brought to the mouth of the user by again contracting his arm muscles. Users will frequently aim their mouths toward the food after the food has been raised a certain distance. (5) Food F is released into the mouth of the user by releasing the squeezing pressure of hand H upon arms 4 and 11 or by overcoming the pressure by positive pressure hinge 8. Optimal positive pressure of 2.7 kg is required to force tip ends 2 and 18 open when the user can not let go so that food F may be deposited in the user's mouth. (6) Tip ends 2 and 18 are withdrawn from the user's mouth and food F is chewed by the user. After this brief rest during the chewing, the arm muscles are again ready to contract for another bite selection. (7) After all of the food F has been deposited in the user's mouth and chewed, tongs 1 are cleaned and sterilized for the next use.

In use, tongs 1 may be held in either hand in a relaxed pen grasp position. This pen grasp position is the relation found with the "Pill Roll" of the Parkinsonian Syndrome. It is also compatible with the ankylosed position found with arthritis.

During the 25 years I spent as a Dentist and in caring for handicapped persons, I have found that handicapped persons are unable to use utensils to feed themselves. No prior art eating utensils are adaptable to most handicapped persons. My invention will resolve the self-feeding difficulties of most handicapped persons.

The handicapped persons routinely are fed or perhaps feed themselves in solitude for the shame of not being able to manage utensils. Some must eat with their fingers which is demeaning to the civilized; they spill which is embarrassing to them. The handicapped persons simply are unable to function with the utensils that you and I consider normal and average. The inability of the handicapped persons to self feed and bit select is demeaning and demoralizing to them. The demoralized handicapped persons are a constant and continuing problem for their families, friends, and health personnel. My invention is designed to secure to the handicapped persons a physical and psychological independence necessary for their morale.

My invention can resolve the self feeding difficulties of many of our handicapped persons. My invention will allow self feeding and bit selection by most handicapped persons, including the arthritic, the blind, the Parkinsonian, the plegic, the dysplastic, the aged, and persons with damaged nervous systems. My invention can be used by a person with a dead hand if his arm still functions. My invention can be used with the mechanical prosthesis of a quadraplegic if a nerve in the arm can be twitched. My invention will free nursing and auxiliary help from the necessity of feeding most handicapped persons.

My invention is a utensil adapted to handicapped capabilities. My invention eliminates the need for dexterity and balancing required when using chopsticks or forks. The muscle control required to manage chopsticks is eliminated. The balancing required to manage forks is eliminated. My invention will provide an element of physical and psychological independence for the handicapped person.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. Food tongs for aiding handicapped persons to feed themselves comprising a pair of arms, a hinge integrally connected to said arms at one end thereof, a tip provided on the opposite end of each arm, each arm having straight lateral edges and being semi-circular in cross-section, each tip being rounded to thereby protect the face and lips of the user, a shallow concavity formed in the inner surface of each arm between the sides thereof and in proximity to the tip to thereby provide a gripping surface, a first loop connected to the outer surface of one of the arms and being dimensioned to accommodate at least two fingers of the handicapped person, said first loop being positioned at a distance of one third of the length of said arm from said hinge to allow the distal joints of the fingers to fit within said first loop; a second loop connected to the outer surface of the other arm and being dimensioned to accommodate the thumb of the handicapped person, said second loop being offset a short distance behind the finger loop toward the hinge to allow the distal joint of the thumb to fit within said second loop; said hinge having a biasing force urging the tip ends of the tong to spread apart in opposed spaced relation whereby, with the fingers and thumb of the handicapped person extending longitudinally of the tong arms and inserted within their respective loops, application of pressure to the arms through the thumb and fingers causes the tip ends of the arms to be brought together to thereby facilitate the grasp of a piece of food, the biasing force of said hinge opening the tip ends of the tong when the pressure is released therefrom to thereby facilitate releasing the grasped food to be eaten by the handicapped person.

2. The self-feeding tongs of claim 1, wherein the hinge includes a bend and an inside surface, the bend integrally connects the ends of the arms, each loop is perpendicular to the longitudinal axis of the arm to which it is attached.

3. The self-feeding tongs of claim 2, wherein the loop for the finger is made to accommodate two fingers and can be expanded to hold three fingers, the loops are made of a material which is adjustable to permit the proper fitting of various sizes of thumb and fingers.

4. The self-feeding tongs of claim 1, wherein the shallow concavity has a length of one-fourth of the length of the tongs, the remaining length of each arm being flat on its inner surface.

5. The self-feeding tongs of claim 4, wherein the overall length of the tongs is six inches, the width of the arms except for the rounded tip ends is one half inch, and the loops have a width of at least one half inch.

6. The self-feeding tongs of claim 4, wherein the positive pressure is in the range of 1.36 kg to 5.4 kg.

* * * * *